US010714904B2

(12) United States Patent
Gozawa

(10) Patent No.: US 10,714,904 B2
(45) Date of Patent: Jul. 14, 2020

(54) SPARK PLUG

(71) Applicant: NGK SPARK PLUG CO., LTD., Nagoya-shi, Aichi (JP)

(72) Inventor: Tatsuya Gozawa, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 16/549,250

(22) Filed: Aug. 23, 2019

(65) Prior Publication Data

US 2020/0106246 A1 Apr. 2, 2020

(30) Foreign Application Priority Data

Aug. 27, 2018 (JP) ..... 2018-158069
May 21, 2019 (JP) ..... 2019-095225

(51) Int. Cl.
*H01T 13/18* (2006.01)
*H01T 13/54* (2006.01)

(52) U.S. Cl.
CPC ..... *H01T 13/18* (2013.01); *H01T 13/54* (2013.01)

(58) Field of Classification Search
CPC ..... H01T 13/18; H01T 13/54; H01T 13/00; H01T 13/06; H01T 13/04; H01T 13/40–44; H01T 13/50; H01T 13/52; H01T 13/20; H01T 13/32; F02P 13/00; F02P 3/02; F02M 57/06
See application file for complete search history.

(56) References Cited

U.S. PATENT DOCUMENTS

2012/0248964 A1* 10/2012 Thomas ..... H01T 13/54 313/141
2013/0206122 A1* 8/2013 Chiera ..... H01T 13/54 123/594
2016/0053670 A1* 2/2016 Tozzi ..... F02B 19/08 123/260

FOREIGN PATENT DOCUMENTS

JP 2017-103179 A 6/2017

* cited by examiner

*Primary Examiner* — Joseph L Williams
*Assistant Examiner* — Jose M Diaz
(74) *Attorney, Agent, or Firm* — Sughrue Mion, PLLC

(57) ABSTRACT

A spark plug includes: an insulator with an axial hole; a center electrode held in a front end side of the axial hole; a cylindrical metal shell disposed around the insulator and having a seal part brought into contact with an outer circumferential surface of the insulator; a ground electrode arranged to form a gap with the center electrode; and a cap connected to a front end part of the metal shell to define therein an auxiliary combustion space in which the gap is formed, the cap having at least one through hole formed to provide communication between the auxiliary combustion space and the outside, wherein the condition (B/A)≤0.25 is satisfied where A represents a volume of an imaginary space defined at a position frontward of the seal part; and B represents a volume of parts of the ground and center electrodes located in the imaginary space.

4 Claims, 6 Drawing Sheets

CROSS SECTION CF1
(A-A CROSS SECTION)

CROSS SECTION CF1
(A-A CROSS SECTION)

CROSS SECTION CF2
(B-B CROSS SECTION)

CROSS SECTION CF1
(A-A CROSS SECTION)

CROSS SECTION CF2

(B-B CROSS SECTION)

CROSS SECTION CF1

(A-A CROSS SECTION)

MODIFIED EXAMPLE

SPARK PLUG

BACKGROUND

The present invention relates to a spark plug.

Conventionally, spark plugs are used in internal combustion engines such as gasoline engines and gas engines. Japanese Laid-Open Patent Publication No. 2017-103179 discloses a spark plug of the type having an auxiliary combustion chamber. In this spark plug, a cap is fixed to a front end part of a metal shell such that the auxiliary combustion chamber is defined within the cap. A hole is formed in the cap so as to provide communication between the auxiliary combustion chamber and the outside. An air-fuel mixture is introduced into the auxiliary combustion chamber through the hole of the cap. Further, a center electrode and a ground electrode are disposed in the auxiliary combustion chamber. When a spark discharge is generated in a gap between the center electrode and the ground electrode, the air-fuel mixture introduced into the auxiliary combustion chamber is ignited by the spark discharge. A flame is developed upon the ignition, and propagates to the outside, that is, to the combustion chamber of the internal combustion chamber through the hole of the cap. By such flame propagation, the air-fuel mixture in the combustion chamber is burned.

SUMMARY

However, it cannot be said that the above-disclosed type of spark plug has been devised sufficiently to reduce the heat and pressure losses in the auxiliary combustion chamber. There is thus a possibility that the heat and pressure losses in the auxiliary combustion chamber become excessively increased, whereby the spark plug may not achieve adequate ignition ability (such as combustion stability).

One main advantage of the present invention is to provide a spark plug of the type having an auxiliary combustion chamber and capable of achieving improved ignition ability.

According to one aspect of the present invention, there is provided a spark plug, comprising: a center electrode extending in a direction of an axis of the spark plug; an insulator having an axial hole formed therein in the direction of the axis to hold the center electrode in a front end side of the axial hole; a cylindrical metal shell disposed around an outer circumference of the insulator and having a seal part brought into contact with an outer circumferential surface of the insulator directly or via another member; a ground electrode arranged to form a gap with the center electrode; and a cap connected to a front end part of the metal shell so as to cover a front end opening of the metal shell and define therein an auxiliary combustion space in which the gap is formed, the cap having at least one through hole formed therein to provide communication between the auxiliary combustion space and the outside, wherein the condition $(B/A) \leq 0.25$ is satisfied where an imaginary plane extending perpendicular to the axis to close an front end opening of the axial hole of the insulator is assumed as a first imaginary plane; an imaginary plane having a minimum area to close an inner surface-side opening of the at least one through hole of the cap is assumed as a second imaginary plane; A represents a volume of an imaginary space defined by an inner surface of the cap, a surface of the metal shell, a surface of the insulator, the first imaginary plane and the second imaginary plane; and B represents a volume of parts of the center and ground electrodes located in the imaginary space.

It is understood that the present invention can be embodied in various forms such as not only a spark plug but also an ignition device with a spark plug, an internal combustion engine with a spark plug, and the like.

The other objects and features of the present invention will also become understood from the following description.

DETAILED DESCRIPTION

Hereinafter, the present invention will be described in detail below with reference to the drawings.

A. Embodiment

Figure 1:
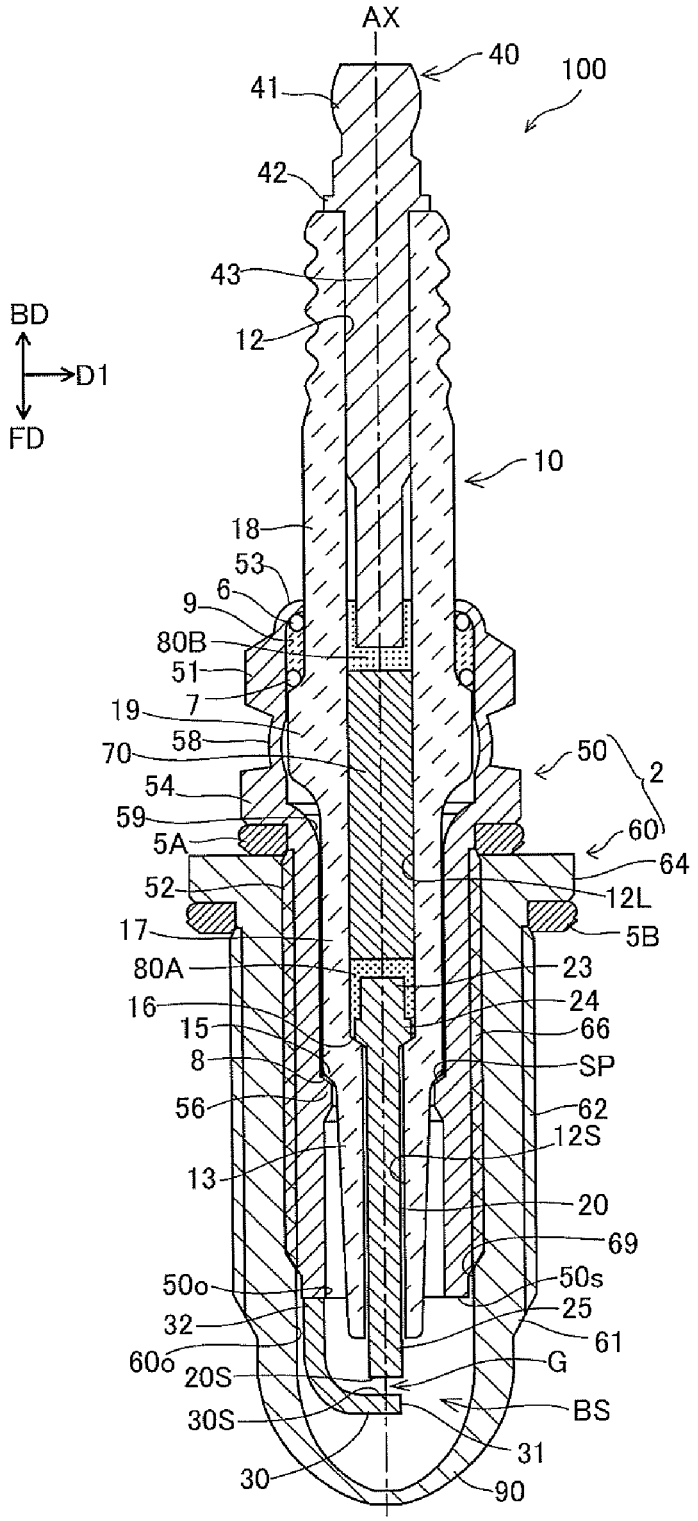
FIG. 1 is a cross-sectional view of a spark plug 100 according to an embodiment of the present invention.

FIG. 1 is a cross-sectional view of a spark plug 100 according to one embodiment of the present invention. In the present specification, a direction parallel to an axis AX of the spark plug 100 (i.e. a vertical direction in FIG. 1) is also referred to as "axial direction"; a direction of a radius of a circle drawn on a plane perpendicular to and centering on the axis AX is also referred to as "radial direction"; and a direction along a circumference of the circle is also referred to as "circumferential direction". Further, upper and lower sides in FIG. 1 are referred to as rear and front sides of the spark plug 100, respectively. A direction toward the front side is referred to as "frontward direction FD"; and a direction toward the rear side is referred to as "rearward direction BD".

The spark plug 100 is adapted for use in an internal combustion engine such as gas engine to ignite a fuel gas in a combustion chamber of the internal combustion engine. As shown in FIG. 1, the spark plug 100 includes an insulator 10, a center electrode 20, a ground electrode 20, a terminal electrode 40, a metal shell 2 with inner and outer metal shell members 50 and 60, a resistor 70, conductive seal members 80A and 80B and a cap 90.

The insulator 10 has a substantially cylindrical shape with an axial hole 12 formed therethrough along the axis AX. In the present embodiment, the insulator 10 is made of a ceramic material such as alumina. The insulator 10 includes a collar portion 19, a rear body portion 18, a front body portion 17, an outer diameter-decreasing portion 15 and a leg portion 13.

The collar portion 19 is located at a substantially middle part of the insulator 10 in the axial direction. The rear body portion 18 is located rearward of the collar portion 19 and has an outer diameter smaller than that of the collar portion 19. The front body portion 17 is located frontward of the collar portion 19 and has an outer diameter smaller than that of the rear body portion 18. The leg portion 13 is located frontward of the front body portion 17 and has an outer diameter smaller than that of the front body portion 17 and gradually decreasing toward the front. The outer diameter-decreasing portion 15 is located between the leg portion 13 and the front body portion 17 and has an outer diameter gradually decreasing from the rear toward the front.

The insulator 10 includes, as its inner circumferential configuration, a large inner diameter region 12L, a small inner diameter region 12S and an inner diameter-decreasing region 16. The large inner diameter region 12L is located in a rear end side of the insulator 10. The small inner diameter region 12S is located frontward of the large inner diameter region 17 and is smaller in inner diameter than the large inner diameter region 12L. The inner diameter-decreasing region 16 is located between the large inner diameter region 12L and the small inner diameter region 12S so as to gradually decrease in inner diameter from the rear toward the front. In the present embodiment, the position of the inner diameter-decreasing region 16 in the axial direction corresponds to the position of a front end part of the front body portion 17 in the axial direction.

The inner metal shell member 50 is made of a conductive metal material such as low carbon steel, and has a cylindrical shape with a through hole 59 formed therethrough along the axis AX. The inner metal shell member 50 is disposed around an outer circumference of the insulator 10 so as to surround the insulator 10 in the radial direction. In other words, the insulator 10 is inserted and held in the through hole 59 of the inner metal shell member 50, with a front end part of the insulator 10 (leg portion 13) protruding toward the front from a front end of the inner metal shell member 50 and a rear end part of the insulator 10 protruding toward the rear from a rear end of the inner metal shell member 50.

The inner metal shell member 50 includes a hexagonal column-shaped tool engagement portion 51 formed for engagement with a plug wrench, a mounting thread portion 52 formed with a male thread for mounting thereon the outer metal shell member 60 and a collar-shaped seat portion 54 formed between the tool engagement portion 51 and the mounting thread portion 52. In the present embodiment, the mounting thread portion 52 has a nominal diameter of e.g. M8 to M14.

An annular metallic inner gasket 5A is fitted on a part of the inner metal shell member 50 between the mounting thread portion 52 and the seat portion 54 so as to seal a clearance between the seat portion 54 of the inner metal shell member 50 and the after-mentioned seat portion 64 of the outer metal shell member 60.

The inner metal shell member 50 also includes a thin crimp portion 53 provided rearward of the tool engagement portion 51 and a thin compression deformation portion 58 provided between the seat portion 54 and the tool engagement portion 51. Annular line packings 6 and 7 are arranged in an annular space between an inner circumferential surface of a part of the inner metal shell member 50 from the tool engagement portion 51 to the crimp portion 53 and an outer circumferential surface of the rear body portion 18 of the insulator 10. A part of the annular space between these two line packings 6 and 7 is filled with a powder of talc 9. A rear end of the crimp portion 53 is crimped radially inwardly and fixed to the outer circumferential surface of the insulator 10. The compression deformation portion 58 is compression deformed as the crimp portion 53 fixed to the outer circumferential surface of the insulator 10 is pushed toward the front during manufacturing of the spark plug 100. With such compression deformation of the compression deformation portion 58, the insulator 10 is pushed toward the front via the line packings 6 and 7 and the talc 9 within the inner metal shell member 50. The inner metal shell member 50 further includes a step portion 56 formed on its inner circumference at a position corresponding to the mounting thread portion 52. As the insulator 10 is pushed toward the front, the outer diameter-decreasing portion 15 of the insulator 10 is pressed against the step portion 56 via an annular plate packing 8. The plate packing 8 is hence held between the outer diameter-decreasing portion 15 and the step portion 56 so as to prevent gas leakage from the combustion chamber of the internal combustion engine through a clearance between the inner metal shell member 50 and the insulator 10.

Herein, a part of the step portion 56 brought into contact with the outer circumferential surface of the insulator 10 (more specifically, the outer circumferential surface of the outer diameter-decreasing portion 15) via the plate packing 8 is also referred to as "seal part SP".

The outer metal shell member 60 is made of a conductive metal material, which is the same as or similar to that of the inner metal shell member 50, and has a cylindrical shape with a through hole 69 formed therethrough along the axis AX. The outer metal shell member 60 is disposed on an outer circumference of the inner metal shell member 50 at a position frontward of the seat portion 54 of the inner metal shell member 50. A female thread 66 is formed on an inner circumferential surface of the outer metal shell member 60 and engaged with the male thread of the mounting thread portion 52 of the inner metal shell member 50. By engagement of the male thread and the female thread 66, a part of the inner metal shell member 50 located frontward of the seat portion 54 is inserted and held in the through hole 69 of the outer metal shell member 60.

The outer metal shell member 60 includes a mounting thread portion 62 and a seat portion 64 formed at a position rearward of the mounting thread portion 62 as shown in FIG. 1. In the present embodiment, the mounting thread portion 62 has a nominal diameter of e.g. M10 to M18. A male thread is formed on an outer circumferential surface of the mounting thread portion 62 such that spark plug 100 is mounted to an engine head of the internal combustion engine by screwing the male thread into a plug hole of the engine head.

An annular metallic outer gasket 5B is fitted on a part of the outer metal shell member 60 between the mounting thread portion 62 and the seat portion 64 so as to, when the spark plug 100 is mounted to the internal combustion engine, seal a clearance between the spark plug 100 and the internal combustion engine (engine head).

The cap 90 is connected to a front end part 61 of the outer metal shell member 60 so as to close front end openings 60*o* and 50*o* of the outer and inner metal shell members 60 and 50. The configuration of the cap 90 will be explained in more detail later. There is an auxiliary combustion space BS defined by the cap 90 so that the after-mentioned gap G is formed in the auxiliary combustion space BS.

The cap 90 is made of a highly corrosion- and heat-resistant metal material such as nickel (Ni), Ni-based alloy (as exemplified by NCF 600, NCF 601 etc.) or tungsten (W). In the present embodiment, the outer metal shell member 60 is made of a Ni alloy; and the cap 90 is made integral with the outer metal shell member 60. In other words, the outer metal shell member 60 and the cap 90 are formed in one piece of the same material. The cap 90 may alternatively be formed separately from the outer metal shell member 60 and joined by welding to the front end part 61 of the outer metal shell member 60.

The center electrode 20 has a rod shape extending along the axis AX. In the present embodiment, the center electrode 20 is made of a highly corrosion- and heat-resistant metal material such as nickel (Ni) or Ni-based alloy (as exemplified by NCF 600, NCF 601 etc.). Alternatively, the center electrode 20 may have a double-layer structure including an electrode base made of e.g. Ni or Ni alloy and a core embedded in the electrode base and made of e.g. copper (Cu) or Cu-based alloy having higher thermal conductivity than that of the electrode base. The center electrode 20 is inserted and held in a front end side of the axial hole 12 of the insulator 10.

The center electrode 20 includes a collar portion 24 formed at a predetermined position in the axial direction, a head portion 23 (as an electrode head) located rearward of the collar portion 24 and a leg portion 25 (as an electrode leg) located frontward of the collar portion 24. The collar portion 24 is supported from its front end side by the inner diameter-decreasing portion 16 of the insulator 10, i.e., retained on the inner diameter-decreasing portion 16 of the insulator 10. A rear end part of the leg portion 25 is disposed in the axial hole 12 (small inner diameter region 12S), whereas a front end part of the leg portion 25 protrudes from a front end of the insulator 10. A front end surface of the leg portion 25 serves as a first discharge surface 20S that forms a gap G with the after-mentioned second discharge surface 30S of the ground electrode 30.

The terminal electrode 40 has a rod shape extending in the axial direction. The terminal electrode 40 is inserted into the axial hole 12 of the insulator 10 from the rear end side and located rearward of the center electrode 20 in the axial hole 12. The terminal electrode 40 is made of a conductive metal material such as low carbon steel. A plating of Ni etc. is applied to a surface of the terminal electrode 40 for prevention of corrosion.

The terminal electrode 40 includes a collar portion 42 (as a terminal collar) formed at a predetermined position in the axial direction, a cap attachment portion 41 located rearward of the collar portion 42 and a leg portion 43 (as a terminal leg) located frontward of the collar portion 42. The cap attachment portion 41 is exposed from the rear side of the insulator 10, whereas the leg portion 43 is inserted and disposed in the axial hole 12 of the insulator 12. Although not specifically shown in the drawings, a plug cap with a high-voltage cable is attached to the cap attachment portion 41 so as to apply a high voltage for generation of a spark discharge.

The resistor 70 is arranged between a front end of the terminal electrode 40 and a rear end of the center electrode 20 within the axial hole 12 of the insulator 10. The resistor 70 has a resistance of e.g. 1 KΩ or higher (in the present embodiment, 5 KΩ) and performs the function of reducing radio noise caused at the time of generation of a spark discharge. The resistor 70 is made of e.g. a composition containing particles of glass as a predominant component, particles of ceramic material other than glass and a conductive material.

A space between the resistor 70 and the center electrode 20 within the axial hole 12 is filled with the conductive seal member 80A; and a space between the resistor 70 and the terminal electrode 40 within the axial hole 12 is filled with the conductive seal member 80B. In other words, the seal member 80A is brought into contact with the center electrode 20 and with the resistor 70 so as to space the center electrode 20 and the resistor 70 apart from each other; and the seal member 80B is brought into contact with the resistor 70 and the terminal electrode 40 so as to space the resistor 70 and the terminal electrode 40 apart from each other. In this way, the seal members 80A and 80B are arranged to electrically and physically connect the center electrode 20 and the terminal electrode 40 to each other via the resistor 70. Each of the seal members 80A and 80B is made of a conductive material such as a composition containing particles of glass (such as $B_2O_3$—$SiO_2$ glass) and particles of metal material (such as Cu or Fe).

The ground electrode 30 has a rectangular cross-section column shape with two end portions: a joint end portion 32 and a free end portion 31 located opposite from the joint end portion 32. The joint end portion 32 is joined by e.g. resistance welding to the front end of the inner metal shell member 50. The metal shell 2 (inner and outer metal shell members 50 and 60) and the ground electrode 30 are hence electrically and physically connected to each other. Further, the ground electrode 30 is bent at a middle part thereof by about 90 degrees such that a part of the ground electrode 30 in the vicinity of the joint end portion 32 extends in a direction parallel to the axis AX whereas a part of the ground electrode 30 in the vicinity of the free end portion 31 extends in a direction perpendicular to the axis AX.

The ground electrode 30 is made of a highly corrosion- and heat-resistant metal material such as Ni or Ni-based alloy (as exemplified by NCF 600, NCF 601 etc.). As in the case of the center electrode 20, the ground electrode 30 may alternatively have a double-layer structure including an electrode base made of e.g. Ni or Ni alloy and a core embedded in the electrode base and made of a metal material (such as Cu) having higher thermal conductivity than that of the electrode base. A rear side surface of the free end portion 31 serves as a second discharge surface 30S that forms the gap G with the first discharge surface 20S of the center electrode 20. The first and second discharge surfaces 20S and 30S are opposed to and face each other in the direction of the axis AX. The gap G is a so-called discharge gap in which a spark discharge is generated.

Figure 2:
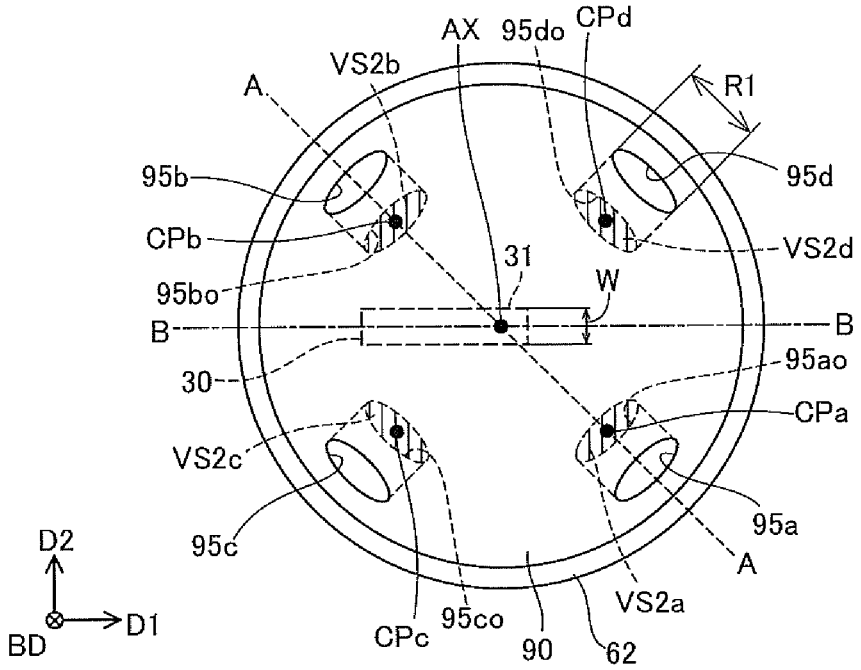
FIG. 2 is an end view of the spark plug 100 as viewed in a direction from the front toward the rear along an axis AX of the spark plug 100.

FIG. 2 is an end view of the spark plug 100 as viewed from the front end side in the rearward direction BD along the axis AX. As shown in FIG. 2, the cap 90 has a plurality of (in the present embodiment, four) through holes 95*a* to 95*d* formed therethrough to provide communication between the auxiliary combustion space BS and the outside. The through holes 95*a* to 95*d* are spaced apart from one another in the circumferential direction. In FIG. 2, openings 95*ao* to 95*do* of the through holes 95*a* to 95*d* at an inner circumferential surface of the cap 90 (hereinafter also referred to as "inner surface-side openings 95*ao* to 95*do*") and the centers CPa to CPd of gravity of the openings 95*ao* to 95*do* are shown for purposes of illustration.

Herein, a direction which passes through the axis AX and in which the free end portion 31 of the ground electrode 30 extends is assumed as a first direction D1; and a direction perpendicular to the first direction D1 is assumed as a second direction D2. In the present embodiment, each of the four through holes 95*a* to 95*d* is arranged at a circumferential position that forms an angle of 45 degrees with the first and second directions D1 and D2. For this reason, the through holes 95*a* to 95*d* are not seen in FIG. 1.

Figure 3:
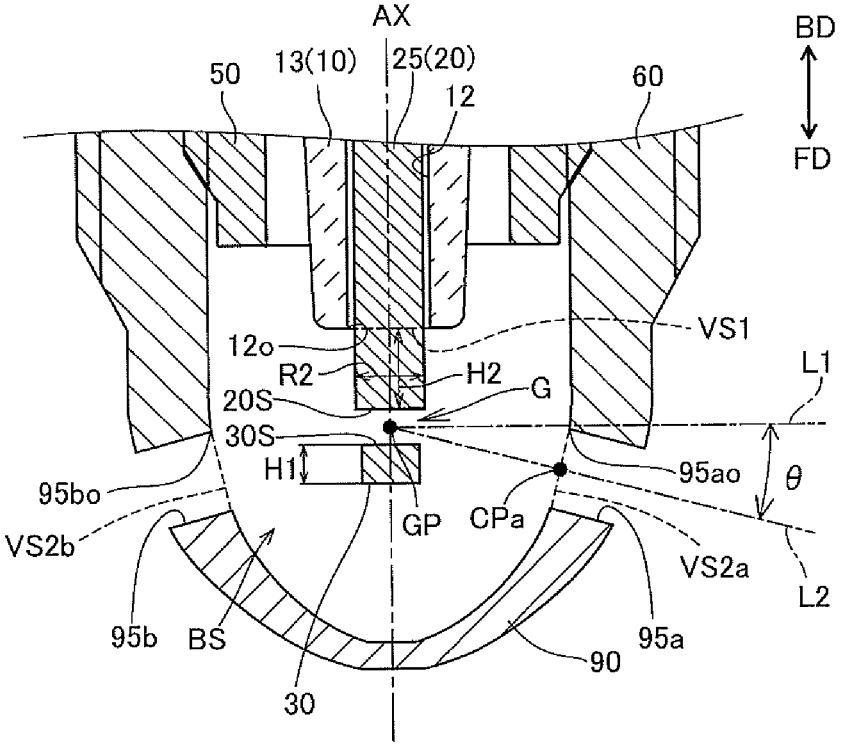
FIG. 3 is a cross-sectional view of a front end part of the spark plug 100 as taken along line A-A of FIG. 2.

FIG. 3 is a cross-sectional view of a front end part of the spark plug 100 as taken along line A-A of FIG. 2. More specifically, FIG. 3 shows a cross section CF1 of the front end part of the spark plug 100 taken along a plane including the axis AX, the center CPa of gravity of the inner surface-side opening 95*ao* of the through hole 95*a* and the center CPb of gravity of the inner surface-side opening 95*bo* of the through hole 95*b*. As shown in FIG. 3, the cap 90 has a substantially semi-spherical, hollow shape. The auxiliary combustion space BS is accordingly substantially semi-spherical in shape.

The front end part of the leg portion 13 (insulator 10), the ground electrode 30 and the front end part of the leg portion 25 (center electrode 20) are situated within the auxiliary combustion space BS. Further, the gap G is situated in the auxiliary combustion space BS.

In the present embodiment, no through holes are formed in the cap 90 at positions intersecting the axis AX as shown in FIGS. 2 and 3. The positions of the four through holes 95*a* to 95*d* in the axial direction generally agree with the position of the free end portion 31 of the ground electrode 30 in the axial direction and the position of the gap G in the axial direction.

As indicated by broken lines in FIG. 3, an imaginary plane extending perpendicular to the axis AX to close the front end opening 12*o* of the axial hole 12 of the insulator 10 is assumed as a first imaginary plane VS1; and imaginary planes having minimum areas to close the inner surface-side openings 95*ao* to 95*do* of the through holes 95*a* to 95*d* are respectively assumed as second imaginary planes VS2*a* to VS2*d*. In FIG. 2, the four second imaginary planes VS2*a* to VS2*d* corresponding to the four inner surface-side openings 95*ao* to 95*do* are indicated by hatching. In FIG. 3, the two second imaginary planes VS2*a* and VS2*b* corresponding to the two inner surface-side openings 95*ao* and 95*bo* are indicated by broken lines.

FIGS. 4A, 4B, 5A and 5B are schematic views for explaining the volume A of an imaginary space VV defined in the spark plug 100 and the volume B of parts VP of the ground and center electrodes 30 and 20 located in the imaginary space VV. More specifically, FIGS. 4A and 5A each show the cross section CF1 of the front end part of the spark plug 100; and FIGS. 4B and 5B each show a cross section CF2 of the front end part of the spark plug 100 taken along line B-B of FIG. 2, i.e., along a plane including the axis AX and extending in parallel to the first direction D1 in which the free end portion 31 of the ground electrode 30 extends.

Figure 4B:
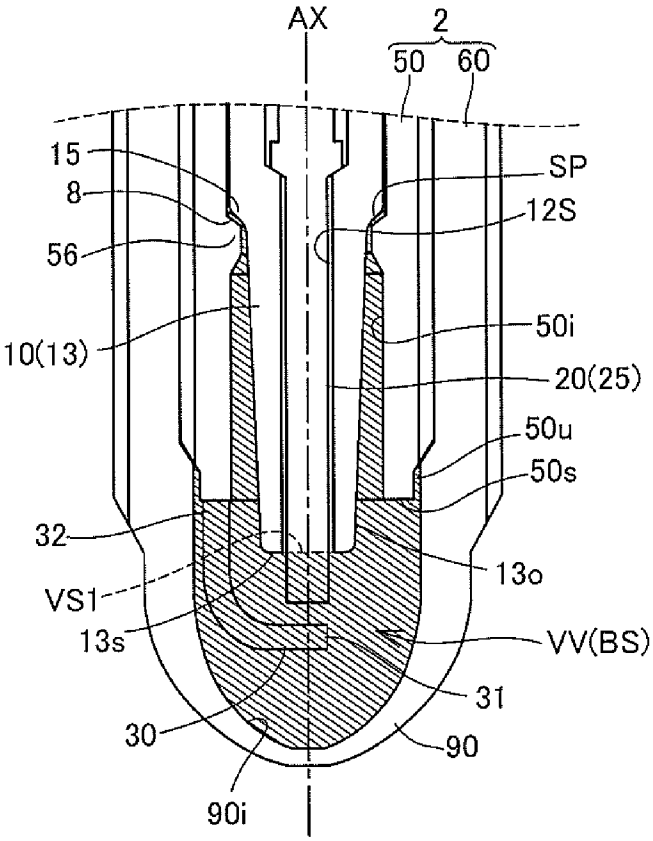
FIGS. 4A and 4B are schematic views for explaining the volume A of an imaginary space defined in the spark plug 100.
Figure 4A:
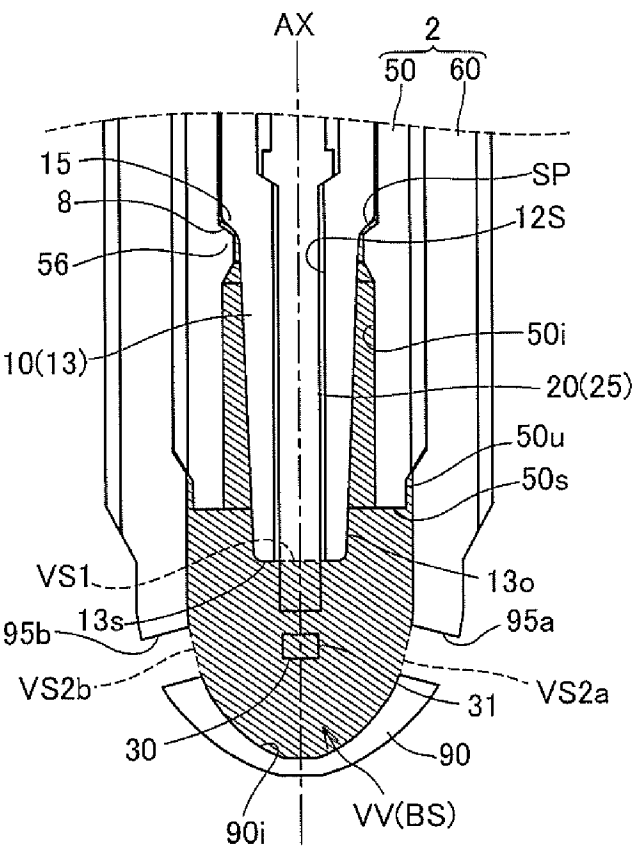

As shown by hatching in FIGS. 4A and 4B, the imaginary space VV is defined, at a location frontward of the seal part SP, by an inner surface 90*i* of the cap 90, a surface of the metal shell 2 (e.g. a front end surface 50*s* and inner and outer circumferential surfaces 50*i* and 50*u* of the inner metal shell member 50), a surface of the insulator 10 (e.g. a front end surface 13*a* and outer circumferential surface 13*o* of the leg portion 13), the first imaginary plane VS1 and the second imaginary planes VS2*a* to VS2*d*. The imaginary space VV is considered to serve as the auxiliary combustion space BS. For purposes of illustration, no hatching is given to parts of the spark plug 100 other than the imaginary space VV (auxiliary combustion space BS) in FIGS. 4A and 4B.

Figure 5B:
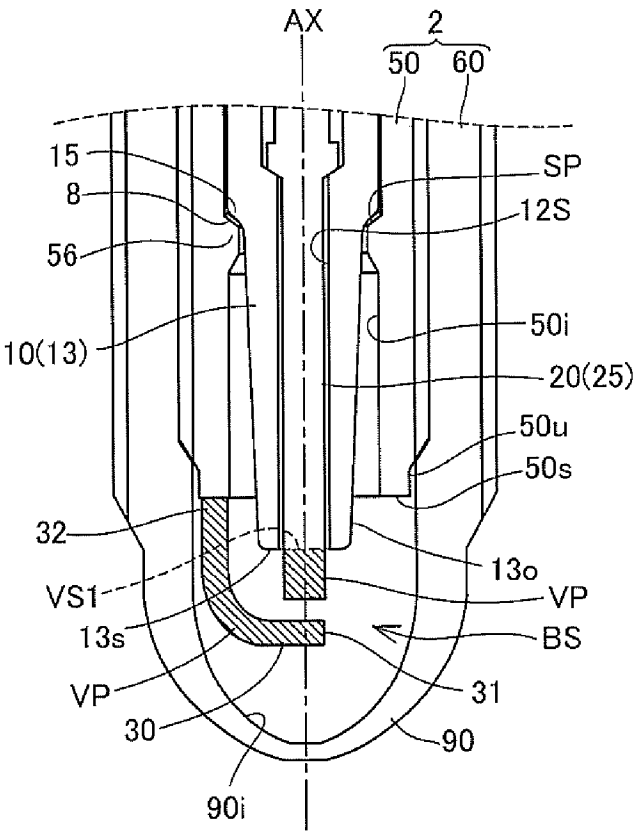
FIGS. 5A and 5B are schematic views for explaining the volume B of parts of ground and center electrodes of the spark plug 100 located in the imaginary space.
Figure 5A:
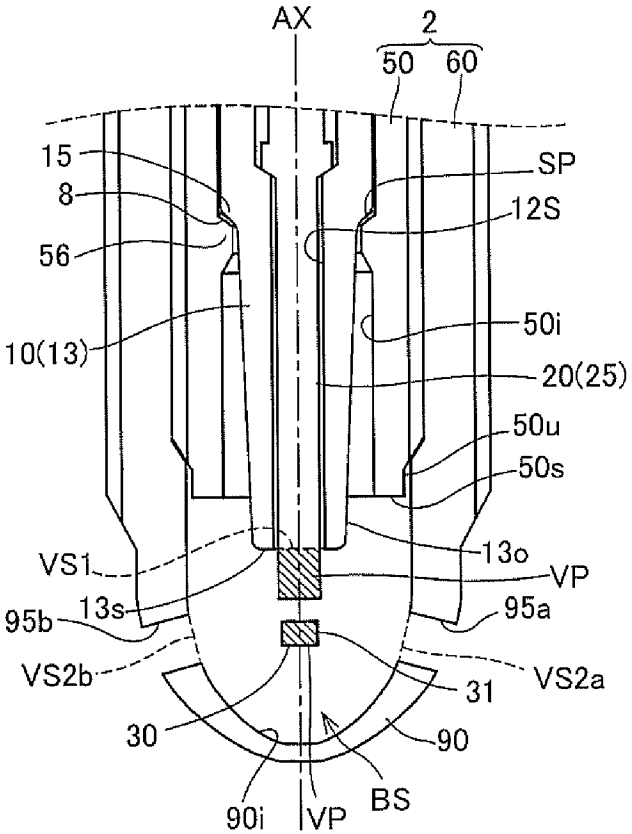

As shown by hatching in FIGS. 5A and 5B, the parts VP of the ground and center electrodes 30 and 20 are located in the imaginary space VV. For the purposes of illustration, no hatching is not given to parts of the spark plug 100 other than the parts VP.

In the present embodiment, the spark plug 100 operates as follows. The spark plug 100 is used by being mounted to the internal combustion engine such as gas engine as mentioned above. Herein, the internal combustion engine is equipped with an ignition system (such as full-transistor ignition system) having a predetermined power source. When a voltage is applied between the ground electrode 30 and the center electrode 20 of the spark plug 100 by the ignition system, a spark discharge is generated in the gap G between the ground electrode 30 and the center electrode 20, that is, in the auxiliary combustion space BS within the cap 9. On the other hand, a fuel gas in the combustion chamber of the internal combustion engine is introduced into the auxiliary combustion space BS through the through holes 95*a* to 95*d* of the cap 90. The fuel gas in the auxiliary combustion space BS is then ignited by the generated spark discharge. With combustion of the ignited fuel gas, a flame is developed and propagates to the outside, that is, to the combustion chamber of the internal combustion engine through the through holes 95*a* to 95*d* of the cap 90. The fuel gas in the combustion chamber of the internal combustion engine is ignited by the propagating flame. As a result, the entire fuel gas in the combustion chamber is burned rapidly even in the internal combustion engine where the combustion chamber is relatively large in volume.

In the case where the flame developed in the imaginary space VV comes into contact with the ground electrode 30 or the center electrode 20 within the imaginary space VV before propagating to the combustion chamber of the internal combustion engine through the through holes 95*a* to 95*d* of the cap 90, there occurs a heat loss (thermal energy loss) of the flame by the quenching effect of the electrode 30, 20. The heat loss of the flame leads to a deterioration of the ignition ability to cause ignition of the fuel gas in the combustion chamber of the internal combustion engine. In the case where the flame developed in the imaginary space VV comes into contact with the ground electrode 30 or the center electrode 20 within the imaginary space VV before propagating to the combustion chamber of the internal combustion engine through the through holes 95*a* to 95*d* of the cap 90, there furthermore occurs a pressure loss of the flame by contact of the flame with the electrode 30, 20. The pressure loss of the flame causes a decrease of the kinetic energy of the flame. Due to such a decrease of the kinetic energy of the flame, it becomes difficult that the flame will grow in the combustion chamber of the internal combustion engine. The pressure loss of the flame thus also leads to a deterioration of the ignition ability.

In the present embodiment, the spark plug 100 is configured to satisfy the condition $(B/A) \leq 0.25$, whereby the volume B of the parts VP of the ground and center electrodes 30 and 20 located in the imaginary space VV is sufficiently small relative to the volume A of the imaginary space VV (as the auxiliary combustion space BS). As a consequence, the heat and pressure losses caused by contact of the flame developed in the imaginary space VV with the electrode 30, 20 are reduced. The spark plug 100 is therefore improved in ignition ability.

It is preferable in the present embodiment to satisfy the condition $(B/A) \leq 0.15$. In this configuration, the volume B of the parts VP of the ground and center electrodes 30 and 20 located in the imaginary space VV is further sufficiently small relative to the volume A of the imaginary space VV. The heat and pressure losses caused by contact of the flame developed in the imaginary space VV with the electrode 30, 20 are consequently further reduced. Thus, the ignition ability of the spark plug 100 is further improved.

It is also preferable in the present embodiment to satisfy the condition $0.005 \leq (B/A)$. In this configuration, the volume B of the parts VP of the ground and center electrodes 30 and 20 located in the imaginary space VV does not become excessively small relative to the volume A of the imaginary space VV. The wear resistance of the ground and center electrodes 30 and 20 is thus prevented from being excessively lowered.

Moreover, it is preferable in the present embodiment that the length of the gap G between the center electrode 20 and the ground electrode 30 in the axial direction, that is, the distance between the first discharge surface 20S and the second discharge surface 30S is 0.2 mm or larger. When the gap G is small in size, the flame developed in the gap G comes into contact with the electrode 30, 20 at the stage that the core of the flame is small. The quenching effect of the electrode 30, 20 becomes large, which results in a large proportion of energy drawn away from the flame. In other words, the smaller the gap G, the smaller the growth of the flame. The quenching effect of the electrodes 30 and 20 is effectively decreased in the case where the length of the gap G is 0.2 mm or larger as compared to the case where the length of the gap G is smaller than 0.2 mm. The amount of heat liberated from the spark plug 100 to the combustion chamber of the internal combustion engine is consequently increased so as to increase the burning speed of the fuel gas. Thus, the ignition ability of the spark plug 100 is further improved.

B. Evaluation Tests

The following evaluation tests were conducted to verify the effects of the above embodiment.

For the evaluation test, 30 kinds of spark plug samples were prepared in which at least one of the number of through holes formed in the cap 90 (hereinafter also simply referred to as "hole number"), the diameter R1 of the respective through holes (hereinafter also simply referred to as "hole diameter R1"; see FIG. 2), the arrangement angle θ of the respective through holes (see FIG. 3), the volume A of the imaginary space VV (see FIG. 4), the volume B of the parts VP of the ground and center electrodes 30 and 20 located in the imaginary space VV (see FIG. 5) and the length of the gap G in the axial direction (hereinafter also referred to as "gap length") was varied.

Herein, the arrangement angle θ will be explained with reference to FIG. 3 by taking the through hole 95*a* as an example. In the cross section CF1 (FIG. 3) taken along the plane including the axis AX and the center CPa of gravity of the inner surface-side opening 95*ao* of the through hole 95*a*, a point situated on the axis AX and equidistant from the first discharge surface 20S and the second discharge surface 30S is assumed as a gap center point GP; a half line starting from the gap center point GP and extending toward the through hole 95*a* in a direction perpendicular to the axis AX is assumed as a first half line L1; and a half line starting from the gas center point GP and passing through the center CPa of gravity of the inner surface-side opening 95*ao* of the through hole 95*a* is assumed as a second half line L2. The arrangement angle θ of the through hole 95*a* is an angle formed between the first and second half lines L1 and L2 in the cross section CF1.

The hole diameter R1 was set to 1 mm or 2 mm. The hole number was set to 2, 4, 6 or 8. The arrangement angle θ was set to 15 degrees, 30 degrees, 45 degrees, 60 degrees or 75 degrees. The volume A was set to 350 $mm^3$, 450 $mm^3$, 550 $mm^3$ or 650 $mm^3$ by adjusting the inner diameter of the cap 90 and the length of the cap 90 in the direction of the axis AX. The volume B was set to 1.4 $mm^3$, 2.4 $mm^3$, 3.3 $mm^3$, 4.1 $mm^3$, 7.3 $mm^3$, 15 $mm^3$, 23.1 $mm^3$, 37.9 $mm^3$, 47.5 $mm^3$, 52.5 $mm^3$, 54.8 $mm^3$, 68 $mm^3$, 87.5 $mm^3$ or 87.8 $mm^3$ by adjusting the outer diameter R2 of the leg portion 25 of the center electrode 20 (see FIG. 3), the protrusion length H2 of the leg portion 25 of the center electrode 20 from the front end of the insulator 10 (see FIG. 3), the length H1 of the free end portion 31 of the ground electrode 30 in the direction of the axis AX (see FIG. 3) and the length W of the free end portion 31 of the ground electrode 30 in the second direction D2 (see FIG. 2). The length of the gap G was set to 0.7 mm, 0.6 mm, 0.5 mm, 0.4 mm, 0.3 mm, 0.2 mm or 0.1 mm.

The hole diameter R1, the hole number, the arrangement angle θ, the volume A, the volume B and the gap length of the respective samples are shown together with the ratio of the volume B to the volume A (hereinafter also referred to as "volume ratio B/A") in TABLE 1.

TABLE 1

| No. | Hole diameter (mm) | Hole number | Arrangement angle (degrees) | Volume A ($mm^3$) | Volume B ($mm^3$) | (B/A) | Gap length (mm) | Combustion stability | Wear resistance | Burning speed |
|---|---|---|---|---|---|---|---|---|---|---|
| 1 | 1 | 4 | 15 | 350 | 1.4 | 0.004 | 0.7 | A | B | A |
| 2 | 1 | 4 | 30 | 350 | 2.4 | 0.007 | 0.7 | A | A | A |
| 3 | 1 | 4 | 45 | 350 | 4.1 | 0.012 | 0.7 | A | A | A |
| 4 | 1 | 4 | 60 | 350 | 7.3 | 0.021 | 0.7 | A | A | A |
| 5 | 1 | 4 | 75 | 350 | 15 | 0.043 | 0.7 | A | A | A |
| 6 | 1 | 4 | 45 | 350 | 23.1 | 0.066 | 0.7 | A | A | A |
| 7 | 1 | 4 | 45 | 350 | 37.9 | 0.108 | 0.7 | A | A | A |
| 8 | 1 | 4 | 45 | 350 | 47.5 | 0.136 | 0.7 | A | A | A |
| 9 | 1 | 4 | 45 | 350 | 52.5 | 0.15 | 0.7 | A | A | A |
| 10 | 1 | 4 | 45 | 350 | 54.8 | 0.157 | 0.7 | B | A | A |
| 11 | 1 | 4 | 45 | 350 | 68 | 0.194 | 0.7 | B | A | A |
| 12 | 1 | 4 | 45 | 350 | 88 | 0.25 | 0.7 | B | A | A |
| 13 | 1 | 4 | 45 | 350 | 87.8 | 0.251 | 0.7 | C | A | A |
| 14 | 1 | 4 | 45 | 450 | 87.8 | 0.195 | 0.7 | B | A | A |
| 15 | 1 | 4 | 45 | 550 | 87.8 | 0.160 | 0.7 | B | A | A |
| 16 | 1 | 4 | 45 | 650 | 87.8 | 0.135 | 0.7 | A | A | A |
| 17 | 1 | 4 | 45 | 650 | 3.3 | 0.005 | 0.7 | A | A | A |
| 18 | 1 | 4 | 45 | 650 | 2.4 | 0.004 | 0.7 | A | B | A |
| 19 | 1 | 2 | 45 | 350 | 15 | 0.043 | 0.7 | A | A | A |
| 20 | 1 | 6 | 45 | 350 | 15 | 0.043 | 0.7 | A | A | A |
| 21 | 1 | 8 | 45 | 350 | 15 | 0.043 | 0.7 | A | A | A |
| 22 | 0.5 | 4 | 45 | 350 | 15 | 0.043 | 0.7 | A | A | A |
| 23 | 1.5 | 4 | 45 | 350 | 15 | 0.043 | 0.7 | A | A | A |
| 24 | 2 | 4 | 45 | 350 | 15 | 0.043 | 0.7 | A | A | A |
| 25 | 1 | 4 | 45 | 350 | 52.5 | 0.15 | 0.6 | A | A | A |

TABLE 1-continued

| No. | Hole diameter (mm) | Hole number | Arrangement angle (degrees) | Volume A ($mm^3$) | Volume B ($mm^3$) | (B/A) | Gap length (mm) | Combustion stability | Wear resistance | Burning speed |
|---|---|---|---|---|---|---|---|---|---|---|
| 26 | 1 | 4 | 45 | 350 | 52.5 | 0.15 | 0.5 | A | A | A |
| 27 | 1 | 4 | 45 | 350 | 52.5 | 0.15 | 0.4 | A | A | A |
| 28 | 1 | 4 | 45 | 350 | 52.5 | 0.15 | 0.3 | A | A | A |
| 29 | 1 | 4 | 45 | 350 | 52.5 | 0.15 | 0.2 | A | A | A |
| 30 | 1 | 4 | 45 | 350 | 52.5 | 0.15 | 0.1 | A | A | B |

The inner diameter of the inner metal shell member 50 was set to 7.2 mm, common to all of the samples.

Using the above-prepared spark plug samples, the combustion stability test, the wear resistance test and the burning speed test were performed.

In the combustion stability test, each sample was tested by mounting the sample to a 1.6-L in-line four-cylinder direct-injection actual gasoline engine with a supercharger and running the gasoline engine for 3000 cycles under the conditions of a rotation speed of 2000 rpm, a net mean effective pressure (NMEP) of 1200 kPa and an air-fuel ratio (A/F) of 14.5. Then, the coefficient of variance (COV) of the net mean effective pressure during the running of the gasoline engine was determined. The lower the coefficient of variance of the net mean effective pressure, the less the likelihood of misfiring, the higher the ignition ability of the sample.

The criteria for evaluation of the combustion stability were as follows: "A" when the coefficient of variance of the net mean effective pressure was lower than 1%; "B" when the coefficient of variance of the net mean effective pressure was higher than or equal to 1% and lower than 2%; and "C" when the coefficient of variance of the net mean effective pressure was higher than or equal to 2%. The combustion stability evaluation results of the respective samples are also shown in TABLE 1.

The combustion stability was evaluated "A" or "B" as for all of the samples of Nos. 1 to 12 and 14 to 30 which met the condition (B/A)≤0.25. By contrast, the combustion stability was evaluated as "C" as for the sample of No. 13 which met the condition (B/A)>0.25. It has been shown from these results that the spark plug 100 achieves improved ignition ability by satisfaction of the condition (B/A)≤0.25.

Among the samples of Nos. 1 to 12 and 14 to 30 which met the condition (B/A)≤0.25, the combustion stability was evaluated as "A" as for the samples of Nos. 1 to 9 and 16 to 30 which met the condition (B/A)≤0.15; whereas the combustion stability was evaluated as "B" as for the samples of Nos. 10 to 12, 14 and 15 which met the condition (B/A) >0.15. It has been shown from these results that the spark plug 100 achieves further improved ignition ability by satisfaction of the condition (B/A)≤0.15.

In the wear resistance test, each sample was tested by mounting the sample to a 2-L in-line four-cylinder direct-injection actual gasoline engine with a supercharger and running the gasoline engine for 100 hours under the conditions of a rotation speed of 4000 rpm, a wide-open throttle (WOT), a net mean effective pressure of 190 kPa and an air-fuel ratio (A/F) of 12. After the running of the gasoline engine, the amount of increase of the gap length was measured. The larger the amount of increase of the gap length, the higher the wear resistance of the sample.

The criteria for evaluation of the wear resistance were as follows: "A" when the amount of increase of the gap length was smaller than 0.2 mm; and "B" when the amount of increase of the gap length was larger than or equal to 0.2 mm and smaller than 0.3 mm. There was no sample in which the gap length was increased by 0.3 mm or more. The wear resistance evaluation results of the respective samples are also shown in TABLE 1.

The wear resistance was evaluated as "A" as for all of the samples of Nos. 2 to 17 and 19 to 30 which met the condition 0.005≤(B/A). By contrast, the wear resistance was evaluated as "B" for both of the samples of Nos. 1 and 18 which met the condition 0.005>(B/A). It has been shown from these results that, by satisfaction of the condition 0.005≤(B/A), the wear resistance of the spark plug 100 is prevented from being excessively lowered.

In the burning speed test, each sample was tested by mounting the sample to a 1.6-L in-line four-cylinder direct-injection actual gasoline engine with a supercharger and running the gasoline engine for 3000 cycles under the conditions of a rotation speed of 2000 rpm, a net mean effective pressure (NMEP) of 1200 kPa and an air-fuel ratio (A/F) of 14.5. Then, the time required to change the mass fraction burned (MFB) of the fuel from 10% to 90% during the running of the gasoline engine was measured. The shorter the measured time, the higher the burning speed of the fuel, the higher the ignition ability of the sample.

Further, an ordinary spark plug with no cap 90 (that is, a standard spark plug for a test gasoline engine) was prepared as a comparative sample and tested in the same manner as above. The rate by which the measured time of the sample was decreased with respect to the measured time of the comparative sample (hereinafter referred to as "decrease rate") was determined.

The criteria for evaluation of the burning speed were as follows: "A" when the decrease rate was higher than 20%; and "B" when the decrease rate was higher than or equal to 10% and lower than 20%. There was no sample by which the decrease rate was lower 10%. The burning speed evaluation results of the respective samples are also shown in TABLE 1.

The burning speed was evaluated as "A" as for all of the samples of Nos. 1 to 29 in which the gap length was larger than or equal to 0.2 mm. By contrast, the burning speed was evaluated as "B" for the sample of No. 30 in which the gap length was smaller than 0.2 mm. It has been shown from these results that the spark plug achieves improved ignition ability by controlling the gap length to be 0.2 mm or larger.

C. Modified Examples

The above-explained specific configuration of the spark plug 100 is merely one merely embodiment and is not intended to limit the present invention thereto.

Figure 6:
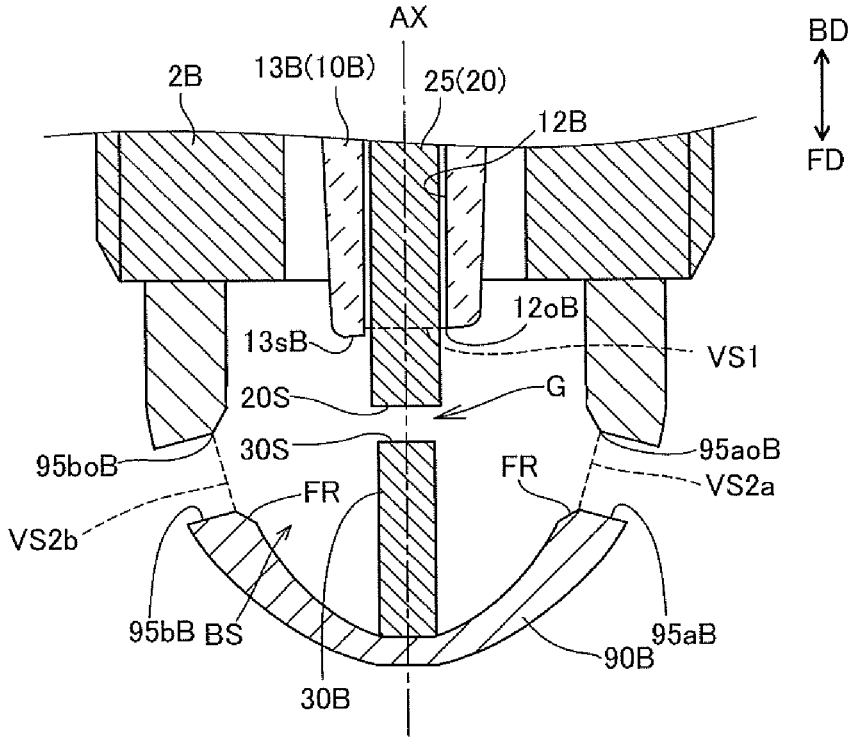
FIG. 6 is a cross-sectional view of a front end part of a spark plug according to a modified example of the embodiment of the present invention.

FIG. 6 is a cross-sectional view of a modified example of the above embodiment of the present invention, as taken corresponding to FIG. 3. The modified example of FIG. 6 is similar in structure to the above embodiment, except for a metal shell 2B, a cap 90B, a ground electrode 30B and an insulator 10B as shown in FIG. 6.

(1) The metal shell 2B is formed in one piece rather than divided into two members. The cap 90B is joined by welding to a front end surface of the metal shell 2B. Further, the ground electrode 30B is formed in a round bar (rod) shape along the axis AX. A rear end surface of the ground electrode 30B serves as a second discharge surface 30S. A front end surface of the ground electrode 30B is joined by welding to an inner surface of the cap 90B. The ground electrode 30B is hence electrically connected to the metal shell 3B via the cap 90B. In this way, the cap and the metal shell can be modified in various forms.

(2) When viewed in cross section as shown in FIG. 6, a front end surface 13*s*B of the insulator 10B (leg portion 13) is not perpendicular to the axis AX but is inclined with respect to the axis AX. A front end opening 12*o*B of the axial hole 12B of the insulator 10B is accordingly inclined in the same manner as the front end surface 13*s*B of the insulator 10B. In this case, an imaginary plane passing through a rear end of the opening 12*o*B and extending perpendicular to the axis AX as shown in FIG. 6 is assumed as a first imaginary plane VS1.

(3) Since chamfered regions FR are provided on inner surface-side openings 95*ao*B and 95*bo*B of the through holes 95*a*B and 95*b*B of the cap 90B as shown in FIG. 6, the through holes 95*a*B and 95*b*B are partially enlarged in diameter. In this case, imaginary planes having minimum areas to close innermost parts of the through holes 95*a*B and 95*b*B except the chamfered regions FR are assumed as second imaginary planes VS2*a* and VS2*b*.

Although not specifically shown in the drawings, the cap 90 may alternatively be formed in a cylindrical shape rather than semi-spherical shape in the above embodiment. In this case, the front end region of the imaginary space VV is cylindrical in shape.

In the above embodiment, the outer circumferential surface of the outer diameter-decreasing portion 15 of the insulator 10 and the seal part SP of the step portion 56 of the inner metal shell member 50 are brought into contact with each other via the plate packing 8. Alternatively, the outer circumferential surface of the outer diameter-decreasing portion 15 of the insulator 10 and the seal part SP of the step portion 56 of the inner metal shell member 50 may be brought into direct contact with each other.

The materials, shapes and dimensions of the respective plug components such as the center electrode 20, the terminal electrode 30, the ground electrode 30 and the metal shell 2 can be varied as appropriate. Although each of the center electrode 20 and the ground electrode 30 is formed of one material in the above embodiment, each of the center electrode 20 and the ground electrode 30 may alternatively be formed including an electrode body and an electrode tip joined to the electrode body and made of a material having higher durability against spark discharge than the material (e.g. Ni alloy) of the electrode body. Such a tip material is exemplified by noble metals such as iridium (Ir) and platinum (Pt), tungsten (W) and an alloy containing at least one kind selected from these metals. In this case, a surface of the electrode tip serves as the discharge surface.

Although the present invention has been described above with reference to the specific embodiment and examples, the above-described embodiment and examples are intended to facilitate understanding of the present invention and are not intended to limit the present invention thereto. Various changes and modifications can be made to the above embodiment and examples without departing from the scope of the present invention. The present invention includes equivalents thereof.

The entire contents of Japanese Patent Application No. 2018-158069 (filed on Aug. 27, 2018) and No. 2019-095225 (filed on May 21, 2019) are herein incorporated by reference. The scope of the present invention is defined with reference to the following claims.

The invention claimed is:

1. A spark plug, comprising:

a center electrode extending in a direction of an axis of the spark plug;

an insulator having an axial hole formed therein in the direction of the axis to hold the center electrode in a front end side of the axial hole;

a cylindrical metal shell disposed around an outer circumference of the insulator and having a seal part brought into contact with an outer circumferential surface of the insulator directly or via another member;

a ground electrode arranged to form a gap with the center electrode; and a cap connected to a front end part of the metal shell so as to cover a front end opening of the metal shell and define therein an auxiliary combustion space in which the gap is formed, the cap having at least one through hole formed therein to provide communication between the auxiliary combustion space and the outside, wherein the condition $(B/A) \leq 0.25$ is satisfied where an imaginary plane extending perpendicular to the axis to close an front end opening of the axial hole of the insulator is assumed as a first imaginary plane; an imaginary plane having a minimum area to close an inner surface-side opening of the at least one through hole of the cap is assumed as a second imaginary plane; A represents a volume of an imaginary space defined by an inner surface of the cap, a surface of the metal shell, a surface of the insulator, the first imaginary plane and the second imaginary plane; and B represents a volume of parts of the center and ground electrodes located in the imaginary space.

2. The spark plug according to claim 1, wherein the condition $(B/A) \leq 0.15$ is satisfied.

3. The spark plug according to claim 1, wherein the condition $(B/A) \geq 0.005$ is satisfied.

4. The spark plug according to claim 1, wherein a length of the gap between the center electrode and the ground electrode in the direction of the axis is 0.2 mm or larger.

* * * * *